United States Patent [19]

Smith et al.

[11] Patent Number: 5,038,076

[45] Date of Patent: Aug. 6, 1991

[54] SLOW WAVE DELAY LINE STRUCTURE HAVING SUPPORT RODS COATED BY A DIELECTRIC MATERIAL TO PREVENT ROD CHARGING

[75] Inventors: Burton H. Smith, Lexington; Colin Bowness, Weston; Andras Dallos, Lincoln, all of Mass.

[73] Assignee: Raytheon Company, Lexington, Mass.

[21] Appl. No.: 348,335

[22] Filed: May 4, 1989

[51] Int. Cl.[5] ..... H01T 23/30

[52] U.S. Cl. ..... 315/3.5; 315/39.3; 330/43

[58] Field of Search ..... 315/3.5, 3.6, 39.3, 315/39; 333/156, 162; 330/43

[56] References Cited

U.S. PATENT DOCUMENTS

| | | | |
|---|---|---|---|
| 2,806,171 | 9/1957 | Iverson | 333/162 X |
| 2,903,657 | 9/1959 | Eichin | 333/162 |
| 3,466,494 | 9/1969 | Eichin et al. | 333/162 |
| 3,474,284 | 10/1969 | Anand | 315/3.5 |
| 3,749,962 | 7/1973 | Smith et al. | 315/3.5 X |
| 3,778,665 | 12/1973 | Harper et al. | 315/3.5 |
| 4,005,329 | 1/1977 | Manoly | 330/43 X |
| 4,107,575 | 8/1978 | Vanderplaats et al. | 315/3.5 |

FOREIGN PATENT DOCUMENTS

| | | | |
|---|---|---|---|
| 458898 | 8/1975 | U.S.S.R. | 315/3.5 |

*Primary Examiner*—Eugene R. LaRoche
*Assistant Examiner*—Benny T. Lee
*Attorney, Agent, or Firm*—Richard M. Sharkansky

[57] ABSTRACT

A radio frequency amplifier having a slow wave structure supported adjacent an electron beam by a support structure. The support structure includes at least one structural support member, having a supporting rod, and a dielectric material disposed on an outer surface portion of the supporting rod. The dielectric material is different from the material of the supporting rod. More particularly the dielectric material is electrically insulating having either a resistivity which reduces upon impingement of electrons from the electron beam or a secondary emission ratio that is substantially unity. The supporting rod has high thermal conductivity and is preferably boron nitride. The dielectric material is preferably titania, magnesia or beryllia.

28 Claims, 3 Drawing Sheets

SLOW WAVE DELAY LINE STRUCTURE HAVING SUPPORT RODS COATED BY A DIELECTRIC MATERIAL TO PREVENT ROD CHARGING

BACKGROUND OF THE INVENTION

This invention relates generally to radio frequency amplifiers and more particularly to amplifiers of such type which include slow wave delay line structures.

As is known in the art, radio frequency amplifiers have a wide range of applications. One type of such, amplifier includes a slow wave delay line structure wherein as an applied radio frequency energy signal propagates down the slow wave delay line structure, the energy therein interacts with an adjacent electron beam in such a way that a portion of the energy in the electron beam is transferred to the propagating wave with the result that the radio frequency energy emerging from the delay line structure is amplified. One type of such amplifier is a travelling wave tube (TWT) amplifier. Here, an electron gun produces a pencil-like beam of electrons having a velocity that typically corresponds to an accelerating voltage of the order of 10 kilovolts. The beam is typically directed from a cathode through a long, loosely wound electrically conductive helix wire, which provides the slow wave delay line structure, to a collector. An axial magnetic focusing field, either uniform or periodic is provided to prevent the beam from spreading and to guide it through the center of the helix. The radio frequency energy signal is applied to the end of the helix wire adjacent the cathode and the amplified signal then appears at the end of the helix wire adjacent the collector. The applied signal propagates around the turns of the helix wire and produces an electric field at the center of the helix that is directed along the helix axis. Since the velocity with which the signal propagates along the helix wire is approximately the velocity of light, the electric field produced by the applied signal advances at a velocity slower than the velocity of light; i.e. it advances at the velocity that is approximately the velocity of light multiplied by the ratio of the helix wire pitch to the helix wire circumference. When the velocity of the electrons in the beam travelling through the helix wire approximates the velocity of the signal propagating axially along the slow wave helix structure, an interaction takes place between the moving signal or wave produced by the electric field, and the moving electrons which is of such a character that on the average, the electrons in the beam deliver energy tc the propagating signal on the helix wire. This causes the signal on the helix wire to become amplified at the output end of the helix wire.

As is also known in the art, various support structures have been used to support the helix wire within the TWT envelope. One type of support structure includes the use of a plurality of dielectric support rods, such as those described in U.S. Pat. No. 3,778,665, issued Dec. 11, 1973, inventors Robert Harper and David Zavadil, and assigned to the same assignee as the present invention. More particularly, the TWT includes a hermetically sealed, elongated, cylindrically shaped envelope. Coaxially disposed within the cylindrical envelope is the helix wire. A plurality, typically 3, symmetrically spaced elongated dielectric rods which extend longitudinally parallel to the common axis of the cylindrical envelope and the helix wire are provided. The rods are of a dielectric material so as to electrically insulate the helix wire from the envelope or ground of the TWT and thereby prevent short circuiting of the applied radio frequency energy signal. The rods have a generally rectangularly shaped cross-section in a plane perpendicular to the common axis. The rods are wedged between inner surface portions of the cylindrically shaped envelope and outer peripheral portions of the helix wire to thereby support the helix wire coaxially aligned within, but electrically insulated from, the elongated cylindrically shaped envelope. The helix, slow wave delay line structure, due to its ohmic resistance as well as electron bombardment, is required to dissipate a considerable amount of thermal energy during the interaction process. Thus, while it is required that the support rods are of dielectric material they must have high thermal conductivity. Typical prior art devices utilize slow wave support structures of nonelectrically conductive but thermally conductive materials such as beryllia, boron nitride, or other ceramics having high thermal conductivity characteristics.

As is further known in the art, the dielectric support rods are susceptible of becoming electrically charged when stray electrons from the electron beam strike them. The resulting charge build-up, if sufficiently large, will cause either the deflection of the electron beam, if unsymmetrical, or act as an electrostatic lens, if symmetrical. This latter phenomenon could increase beam scalloping which could also increase interception by the helix thereby increasing interception current in the helix. Further, rod charging can cause slowing down or deflection of the electron beam, which results in an increase in the current striking the helix wire in a localized area. This can ultimately lead to an excessive rise in the helix wire temperature and ultimately to failure of the tube. Generally, however, a TWT experiencing support rod charging fails due to excessive helix wire interception current.

One method of avoiding this problem is by tedious adjustment of the local magnetic field along the helix wire. This operation, sometimes referred to as shimming, is very time-consuming, since attempts to shim do not always converge to an acceptable result. An additional difficulty is the time taken for the electric charge to build up on the support rods since this may lead to a shimmed tube not performing properly when turned on from a "cold" start.

Another method used to eliminate support rod charging has been to increase the electrical conductivity of the rod surface to prevent the build-up of charge on the rod surface. This approach requires the use of a thin electrically conducting film, such as graphite, on those portions of the rods that are in close proximity to the electron beam, since these portions are in the radio frequency field of the helix they may introduce unwanted loss in the helix circuit. As a consequence, this technique sometimes forces a compromise between achieving a reliable film that is thick enough to prevent rod charging and a film that is not so thick as to introduce radio frequency energy loss.

Finally, as mentioned briefly above, the material typically used for the dielectric helix support rods is boron nitride (BN) or beryllium oxide (BeO). While the beryllium oxide rods do not exhibit rod charging, it is a more difficult material to use from a mechanical fabrication standpoint due to its toxicity and brittleness. Boron nitride, on the other hand, is an easier and more desirable material to use because it is more "forgiving" in its mechanical mating characteristics when it interfaces between the outer peripheral portions of the helix; however, boron nitride does exhibit the aforementioned undesirable rod charging characteristics. Boron nitride also has a lower dielectric constant than beryllia which has electrical advantages.

SUMMARY OF THE INVENTION

It is therefore an object of this invention to provide an improved radio frequency amplifier.

It is a further object of the invention to provide an improved support structure for a slow wave delay line structure used in a radio frequency amplifier.

These and other objects of the invention are obtained generally by providing a radio frequency amplifier having a slow wave structure supported adjacent an electron beam by a support structure. The support structure includes at least one structural support member comprising a supporting rod; and, a dielectric material disposed on an outer surface portion of the support rod. The dielectric material is different from the material of the supporting rod. In accordance with the first feature of the invention, the supporting rod is of a material having high thermal conductivity. Preferably, the supporting rod material is boron nitride. The dielectric material disposed on the outer surface portion of the supporting rod is electrically insulating having a resistivity which reduces upon impingement of electrons and/or having a desired secondary electron emission characteristic. Dielectric materials such as titania, beryllia and magnesia are preferred dielectric materials.

With such a arrangement, boron nitride supporting rods having the desired thermal conductivity and mechanical assembly advantage may now be used without electric charge build-up thereon through the use of a dielectric material on an outer surface portion thereof which, upon impingement of electrons, either has the electrical conductivity thereof reduced to provide a discharge path for impinging electrons or exhibits substantially unity secondary electron emission and thus prevents charge build-up on the structural support members.

The dielectric material is in the form of a thin film having a thickness that is typically less than 1 micron, with the preferred embodiment using 0.1 micron thickness. Such films may conveniently be deposited by evaporation or sputtering methods that are well known.

BRIEF DESCRIPTION OF THE DRAWINGS

The foregoing features of this invention, as well as the invention itself, may be more fully understood from the following detailed description, read together with the accompanying drawings in which.

DESCRIPTION OF THE PREFERRED EMBODIMENT

Figure 1:
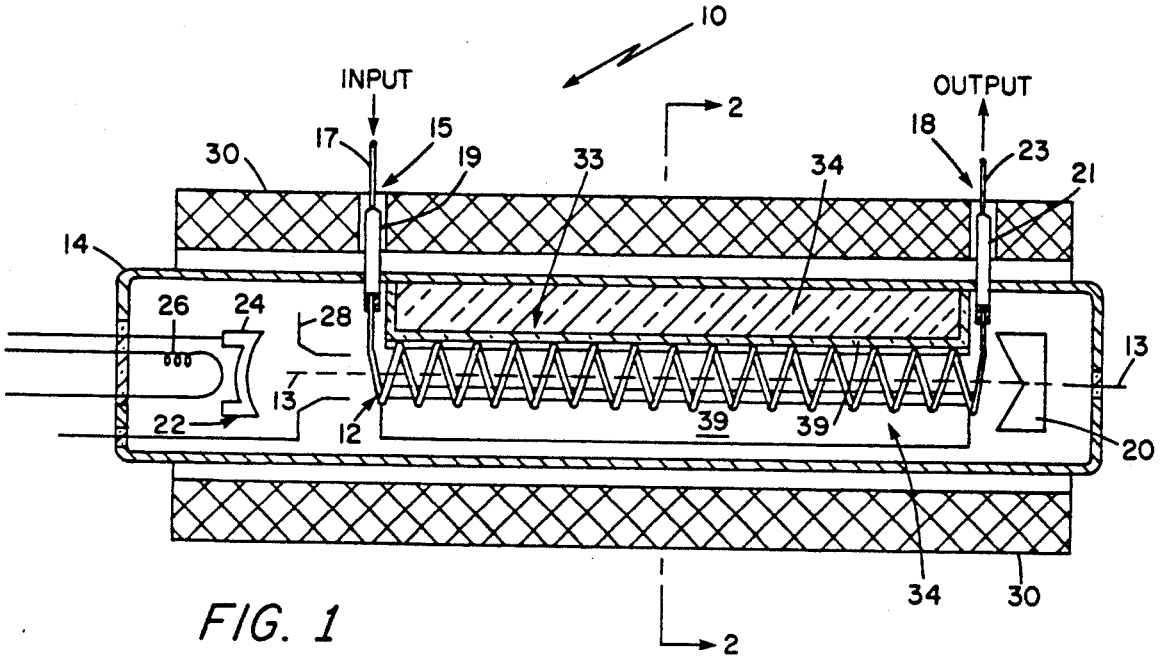
FIG. 1 is a diagrammatic sketch of a longitudinal cross-sectional view of a travelling wave tube (TWT) having a helix slow wave delay line structure supported by structural support members in accordance with the invention.
Figure 2:
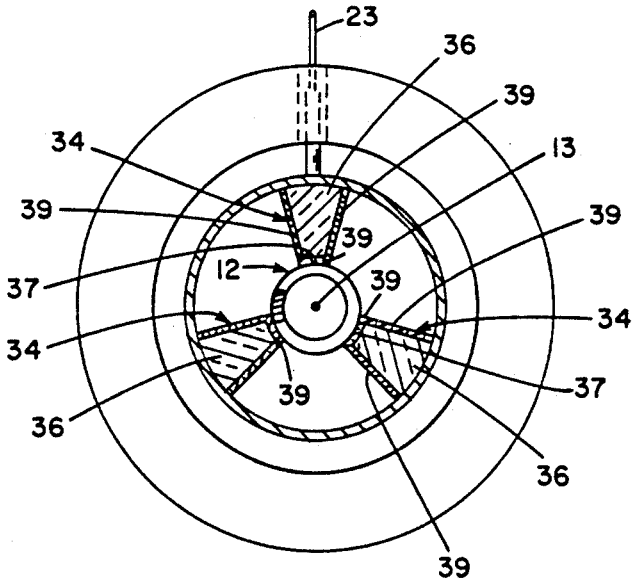
FIG. 2 is a cross-sectional view taken along line 2—2 in FIG. 1.
Figure 3:
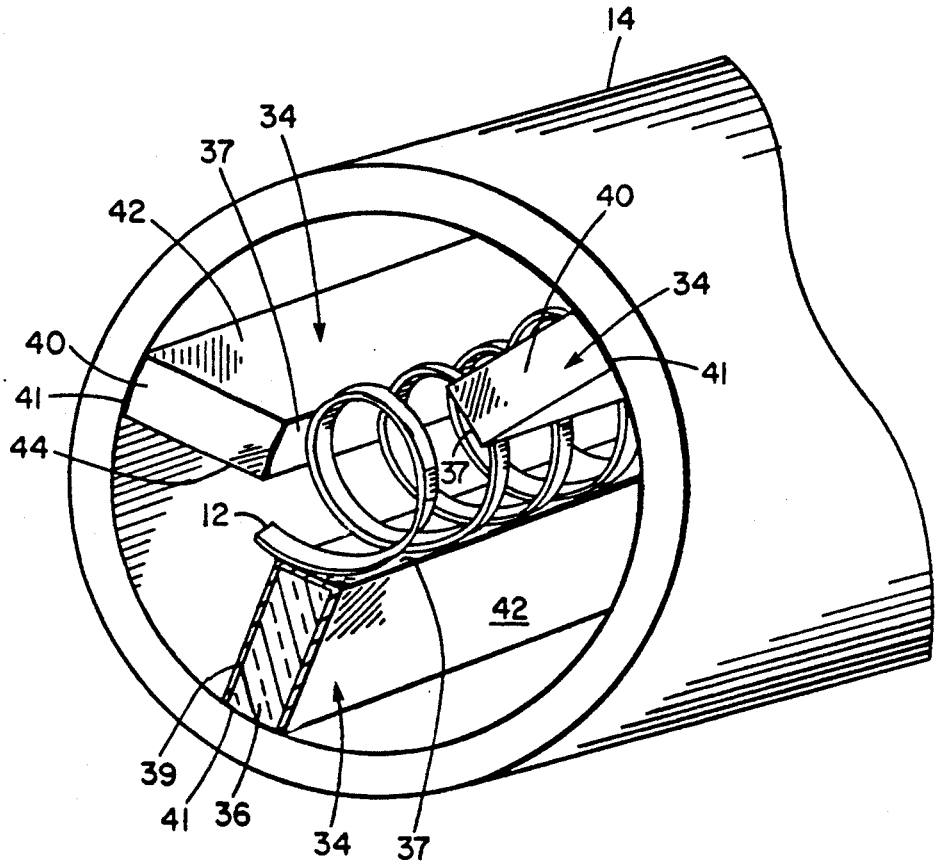
FIG. 3 is a isometric view partially in cross-section of a portion of the travelling wave tube of FIG. 2.

Referring now to FIGS. 1, 2 and 3, a radio frequency amplifier 10, here a travelling wave tube, is shown to include a slow-wave delay line structure, here a helix wire 12, having a plurality of turns extending along the longitudinal axis 13 of an evacuated cylindrically shaped metal envelope 14. A radio frequency signal is coupled to the helix wire 12 by an input conductor 15, here a conventional coaxial transmission line having its inner conductor 17 connected to the left hand end of the helix wire 12 and its outer conductor 19 electrically connected to the envelope 14. An output conductor 18, here also a coaxial transmission line, has its outer conductor 21 electrically connected to the envelope 14 and its inner conductor .23 connected to the right hand end of the helix wire 12.

A gun type electron beam source 22 includes an electron emissive cathode 24 having a slight concave curvature to assist in the focusing of an electron beam trajectory along the longitudinal axis 13 to collector 20. The cathode 24 is heated by a coil 26 and electrical leads extend through the envelope 14 walls to provide for the connection of the components of the gun source to appropriate DC voltage supplies (not shown). An accelerator electrode 28 suitably biased, for example, by a positive voltage potential assists in the beam focusing in a conventional manner. An external magnetic field is produced by magnets 30, which may include any of the high-coercive force permanent magnetic materials, such as samarium cobalt or platinum cobalt or an electromagnet surrounding envelope 14. The produced magnetic field is parallel to the axis 13 of the device in a conventional manner.

Figure 4:
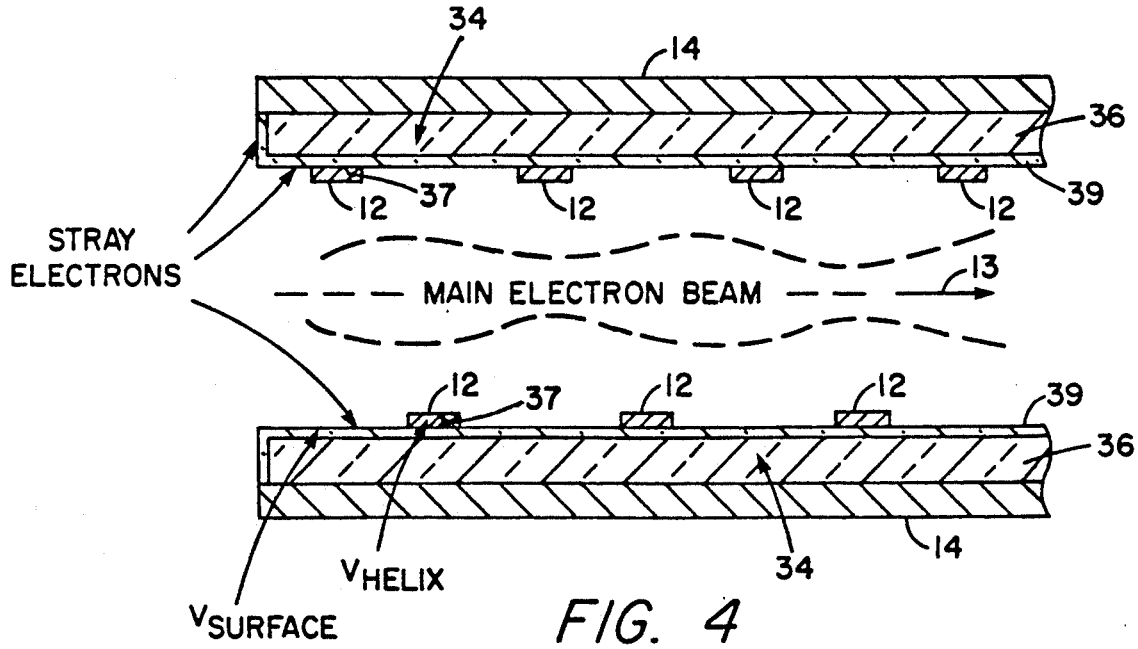
FIG. 4 is a dramatical cross-sectional sketch of a portion of the TWT of FIG. 1 showing the relationship between the structural support structure, an electron beam, and outer peripheral ends of a helix wire, such sketch being useful in understanding features of the invention.
Figure 5:
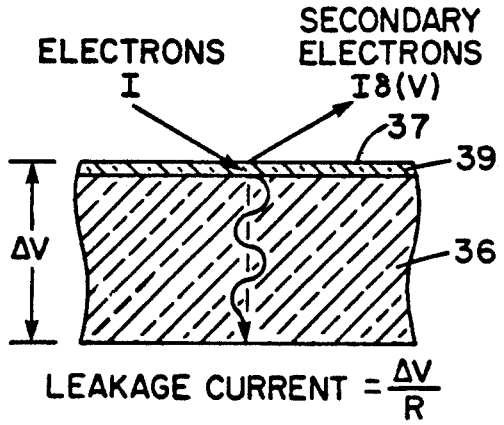
FIG. 5 is a diagram of a dielectric impinged by electrons, such diagram being useful in understanding features of the invention.

The helix slow wave delay line structure 12 comprises a plurality of turns of an electrically conductive wire and is supported within the envelope 14 adjacent the electron beam by a support structure 33. The support structure includes a plurality of elongated non-conductive structural support members 34 disposed longitudinally parallel to the axis 13 of the device. As seen in FIGS. 2 and 3 the structural support members 34 include inner supporting rods 36 of electrically insulating, high thermally conductive material. The coefficient of thermal conductivity of the supporting rods 36 should be high, in order to cool the helix. Here, the supporting rods 36 are boron nitride. The supporting rods 36 here have their outer surfaces coated with a thin film of dielectric material 39. It has been discovered that coating on outer surfaces of the supporting rods 34 with these thin, less than 1 micron thick, films 39 (here having a thickness of 0.1 microns) of dielectric materials such as titania, magnesia or beryllia, virtually eliminates rod charging. It is believed that such electrical charging of the inner surfaces of boron nitride supporting rods 36 is eliminated by disposing over such rods a dielectric material which has a resistivity which reduces upon impingement of electrons or which exhibits substantially unity secondary electron emission ratio. Thus, under electron bombardment from stray electrons in the produced electron beam, charge which otherwise would build up on the surface of a boron nitride rod is dissipated. In the case where the resistivity of the coating material is reduced, charge would dissipate by leaking to the helix. In the case where the coating material exhibits unity secondary electron emission, the charge is dissipated by electron reradiation. Thus, referring to FIGS. 4 and 5, stray electrons from the main electron beam impinge upon inner surface portions 37 of the helix support structure. As shown in FIG. 4, a voltage $V_{surface}$ is produced on the surface of the support structure. The voltage on the helix wire may be represented as $V_{helix}$. Referring also to FIG. 5, a differential voltage $\Delta V$ is produced between the helix wire and the inner surface portions 37 of the dielectric support structure, where $\Delta V = V_{helix} - V_{surface}$ (where $V_{helix}$ is the voltage of the helix relative to the source of the electron beam, here cathode 24 and $V_{surface}$ is the voltage at the surface of the coating 39 relative to the cathode 24).

From FIG. 5

$$\Delta V = [1 - \delta(V)]IR \text{ eq. (1)}$$

From eq. (1) it is evident that $\Delta V$ depends on: the voltage dependent secondary emission ratio [$\delta(V)$]; the leakage resistance R; and, the impinging electron current I. Measurements have shown that the leakage resistance may not be constant but may depend on the ,magnitude of the impinging electron current and voltage. Referring also to FIG. 3, measurements have been made on supporting rods of boron nitride with, and without, sputtering 0.1 micron thick films of titania and magnesia on the inner surface portions 37, the end surface portions 40 facing the cathode 24 and collector 20, and the side portions 42. It is noted therefore that the ends of the outer surfaces 41 of rods 34 contacting the metal envelope 14 are here not coated and hence here the boron nitride is in contact with the envelope 14. The applied voltage was 10 KV and a focused electron beam current was 10 nanoamperes. At normal incidence, the results were as follows:

TABLE I

| Parameter | Uncoated Boron Nitride | Boron Nitride coated with Magnesia | Boron Nitride coated with Titania |
|---|---|---|---|
| Voltage Shift $\Delta V$(KV) | 3.0 | 0.2 | 0.2 |
| Resistance (Ohm) | $1.5 \times 10^{13}$ | $6 \times 10^{11}$ | $3 \times 10^{10}$ |
| Secondary Emission Ratio | 0.98 | 0.98 | 0.3 |

When the impinging current was varied in the 10 to 10,000 nanoampere range, and the angle of incidence was changed from 0° to 60°, the value of differential voltage $\Delta V$ produced across the material was unchanged within the measuring error of about 50 volts. If the rod surface voltage differs by 3 KV (as in the case of the uncoated boron nitride) from the helix voltage of about 10 KV, defocusing occurs. However, if this differential voltage is only 200 volts, as in the ca-e of the titania or magnesia coated boron nitride, the defocusing is negligible. Thus, it has been found that thin metal oxide films of titania, magnesia, or beryllia can eliminate the charging problem through either a mechanism that causes such coatings to become conductive under electron bombardment or through secondary electron emission.

Figure 6:
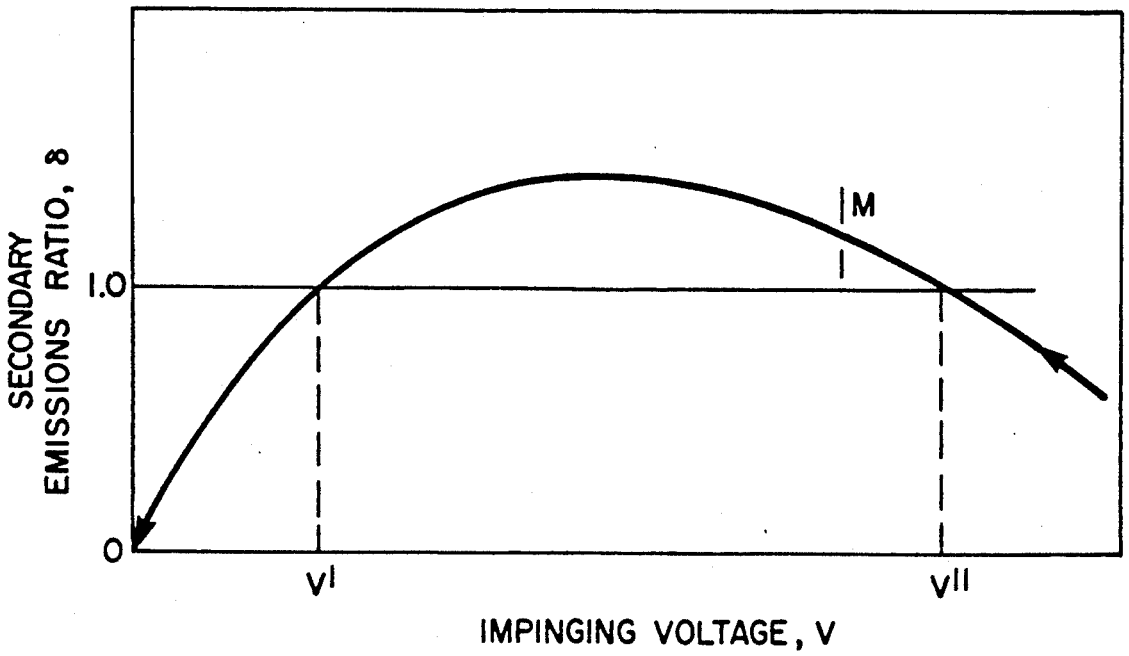
FIG. 6 is a curve showing the secondary emission ratio vs electron beam energy for a material.

The method by which secondary emission ratio differences can explain differences in rod charging can be indicated with the aid of FIG. 6 which shows a typical secondary emission yield as a function of the energy of the arriving electrons. If the emitting surface is of high surface resistance, i.e. a good insulator, the surface will charge up negatively if $\delta < 1$ or positively if $\delta > 1$.

As the surface charges, its voltage will tend to accelerate or decelerate the arriving electrons which will, in turn, effect the secondary emission yield. This effect is such that below V' the surface will charge negatively reducing the energy of the arriving electrons towards zero. Similarly, above, V'', the, potential will be reduced towards V'' Between V' and V'', the surface charges positively, increasing the energy of the arriving electrons until, equilibrum is reached of the point M, close, to the applied (helix) voltage but, below the voltage V''.

The voltage V'' depends on the material used for dielectric coating and its thickness. If R is infinite, the goal is to apply a surface coating such that $V'' = V_{Helix}$. Thus, for a fired tube operating voltage, the coating material and its thickness are selected so that, in combination, the coated surface exhibits a unity secondary electron emission ratio.

Having described preferred embodiments of the invention, it is evident that other embodiments incorporating these concepts may be used. For example, while other dielectrics and oxides have not been tried at this time, it is expected that other materials, such as other metal oxides, may exhibit suitable characteristics (i.e. one which will have its resistivity reduce upon impingement of electrons and/or have a unity secondary electron emission ratio). Further, coating techniques other than sputtering may be used. It is felt, therefore, that this invention should not be restricted to the disclosed embodiments, but rather should be limited only by the spirit and scope of the appended claims.

What is claimed is:

1. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on an in contact with, the first dielectric material of the supporting rod, such second dielectric material being different from the first material of the supporting rod;

wherein said second dielectric material comprises a metal oxide;

wherein the slow wave structure comprises a conductive helix disposed on and in contact with the metal oxide;

wherein the first dielectric material comprises boron nitride; and wherein the metal oxide is magnesia, beryllia or titania.

2. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on an in contact with, the first dielectric material of the supporting rod, such second dielectric material being a material different from the first material; and wherein the second dielectric material is electrically insulating and has a resistivity which reduces upon impingement of electrons from the electron beam.

3. The radio frequency amplifier recited in claim 2 wherein the supporting rod comprises a thermally conductive material.

4. The radio frequency amplifier recited in claim 2 wherein the supporting rod comprises boron nitride.

5. The radio frequency amplifier recited in claim 4 wherein said second dielectric material comprises a metal oxide.

6. The radio frequency amplifier recited in claim 5 wherein the metal oxide is titania.

7. A radio frequency amplifier having a slow wave structure supported adjacent an electron beam by a support structure, such support structure comprising at least one supporting rod comprising boron nitride and having disposed on and in direct contact with said boron nitride, a coating of titania, magnesia or beryllia.

8. A radio frequency amplifier having a slow wave structure supported adjacent an electron beam by a support means, said support means comprising at least one structure support member, such support member comprising;

a supporting rod; and a dielectric material, disposed on a surface portion of the supporting rod, such dielectric material being a material different from the material of the supporting rod, and wherein the dielectric material is electrically insulating having a resistivity which reduces upon impingement of electrons from the electron beam, and wherein the supporting rod is boron nitride, and wherein said dielectric material is a metal oxide and wherein the metal oxide is titania.

9. A radio frequency amplifier having a slow wave structure supported adjacent an electron beam by a support means, said support means comprising at least one structural support member, such support member comprising;

a supporting rod; and a dielectric material, disposed on a surface portion of the supporting rod, such dielectric material being a material different from the material of the supporting rod and wherein said dielectric material exhibits substantially unity secondary electron emission ratio when the amplifier operates at a predetermined voltage applied between the slow wave structure and a source of the electron beam.

10. The radio frequency amplifier recited in claim 9 wherein the supporting rod comprises a thermally conductive material.

11. The radio frequency amplifier recited in claim 9 wherein the supporting rod comprises boron nitride.

12. The radio frequency amplifier recited in claim 9 wherein said dielectric material is magnesia or beryllia.

13. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being different from the first material of the supporting rod;

wherein the slow wave structure comprises a conductive helix wire disposed on and in contact with the second dielectric material;

wherein the first dielectric material comprises boron nitride; and wherein the second dielectric material is magnesia, beryllia or titania.

14. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being a material different from the first material of the supporting rod;

wherein the slow wave structure comprises a conductive helix wire disposed on and in contact with the second dielectric material; and wherein the first dielectric material comprises boron nitride.

15. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being a material different from the first material of the supporting rod;

wherein said second dielectric material comprises a metal oxide; and wherein the metal oxide is titania, magnesia, or beryllia.

16. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being a material different from the first material of the supporting rod;

wherein said second dielectric material comprises a metal oxide; and wherein the first dielectric material comprises boron nitride.

17. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being a material different from the first material of the supporting rod;

wherein the support rod comprises boron nitride;

18. A radio frequency amplifier having a slow wave structure supported adjacent an electron beam by a support, said support comprising at least one structural support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being different from the first material of the supporting rod;

wherein said second dielectric material comprises a metal oxide;

wherein the slow wave structure comprises a conductive helix disposed on and in contact with the metal oxide; and wherein the metal oxide is titania, magnesia, or beryllia.

19. A radio frequency amplifier having a slow wave structure supported adjacent an electron beam by a support, said support comprising at least one structural support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being different from the first material of the supporting rod;

wherein said second dielectric material comprises a metal oxide;

wherein the slow wave structure comprises a conductive helix disposed on and in contact with the metal oxide; and wherein the first dielectric material comprises boron nitride.

20. A radio frequency amplifier having a slow wave structure supported adjacent an electron beam by a support, said support comprising at least one structural support member, such support member comprising:

a supporting rod comprising a first dielectric material;

a deposited coating, comprising a second dielectric material, disposed on and in contact with, the first dielectric material of the supporting rod, such second dielectric material being different from the first material of the supporting rod;

wherein said second dielectric material comprises a metal oxide;

wherein the slow wave structure comprises a conductive helix disposed on and in contact with the metal oxide; and wherein the first dielectric material comprises boron nitride; and wherein the metal oxide is titania, magnesia, or beryllia.

21. A radio frequency amplifier having a slow wave structure supported adjacent an electron beam by a support, said support comprising at least one structural support member, such support member comprising:

a supporting rod comprising a first dielectric material; and a coating, such coating having a thickness less than one micron and comprising a second dielectric material, disposed on and in contact with, the first dielectric material of the supporting rod, such second dielectric material being a material different from the first dielectric material of the supporting rod.

22. The radio frequency amplifier recited in claim 21 wherein the coating consists essentially of a single metal oxide.

23. The radio frequency amplifier recited in claim 21 wherein the coating is titania, magnesia or beryllia.

24. The radio frequency amplifier recited in claim 21 wherein the coating comprises a metal oxide.

25. The radio frequency amplifier recited in claim 24 wherein the first dielectric material is boron nitride.

26. The radio frequency amplifier recited in claim 25 wherein the metal oxide comprises a metal oxide.

27. The radio frequency amplifier recited in claim 26 wherein the metal oxide comprises a single metal oxide.

28. The radio frequency amplifier recited in claim 26 wherein the metal oxide is magnesia, beryllia or titania.

* * * * *